US006906671B2

(12) United States Patent
Oka

(10) Patent No.: US 6,906,671 B2
(45) Date of Patent: Jun. 14, 2005

(54) GLASS ANTENNA AND GLASS ANTENNA SYSTEM USING THE SAME

(75) Inventor: Hidetoshi Oka, Osaka (JP)

(73) Assignee: Nippon Sheet Glass Company, Limited, Osaka (JP)

( * ) Notice: Subject to any disclaimer, the term of this patent is extended or adjusted under 35 U.S.C. 154(b) by 0 days.

(21) Appl. No.: 10/250,642

(22) PCT Filed: Dec. 28, 2001

(86) PCT No.: PCT/JP01/11622

§ 371 (c)(1),
(2), (4) Date: Jul. 3, 2003

(87) PCT Pub. No.: WO02/056412

PCT Pub. Date: Jul. 18, 2002

(65) Prior Publication Data

US 2004/0056810 A1 Mar. 25, 2004

(30) Foreign Application Priority Data

Jan. 4, 2001 (JP) ..... 2001-000006

(51) Int. Cl.[7] ..... H01Q 1/32
(52) U.S. Cl. ..... 343/713; 343/704
(58) Field of Search ..... 343/704, 711, 343/713

(56) References Cited

U.S. PATENT DOCUMENTS 5,663,737 A 9/1997 Kakizawa ..... 343/713
5,719,585 A * 2/1998 Tabata et al. ..... 343/713
5,952,977 A 9/1999 Taniguchi et al. ..... 343/713
6,072,435 A * 6/2000 Terashima et al. ..... 343/713
6,215,450 B1 * 4/2001 Oka ..... 343/713
6,243,043 B1 * 6/2001 Terashima et al. ..... 343/713

FOREIGN PATENT DOCUMENTS

| | | |
|---|---|---|
| EP | 56-66902 | 6/1981 |
| GB | 2 316 538 | 2/1998 |
| JP | 3-254205 | 11/1991 |
| JP | 8-321712 | 12/1996 |
| JP | 9-181514 | 7/1997 |
| JP | 10-13127 | 1/1998 |
| JP | 10-242730 | 9/1998 |
| WO | 00/70708 | 11/2000 |

* cited by examiner

*Primary Examiner*—Tho Phan
(74) *Attorney, Agent, or Firm*—Merchant & Gould P.C.

(57) ABSTRACT

A glass antenna of the present invention includes a window glass: a defogging heater including a plurality of conductive lines arranged on the window glass; a first antenna element and a second antenna element arranged at an upper side relative to the heater on the window glass; and a first feeding point for the first antenna element arranged at a left side of the window glass, and a second feeding point for the second antenna element arranged at a right side of the window glass. The first antenna element and the second antenna element each are capacitively coupled with the heater.

7 Claims, 13 Drawing Sheets

GLASS ANTENNA AND GLASS ANTENNA SYSTEM USING THE SAME

FIELD OF THE INVENTION

The present invention relates to a glass antenna for vehicles, and in particular to a glass antenna system including a diversity antenna that is suitable for receiving signals in the very high frequency (VHF) band

BACKGROUND OF THE INVENTION

Glass antennas in which conductive lines are formed on a vehicle window glass are superior to conventional rod antennas in that (i) they are designed not to protrude outward, (ii) there is little danger of breakage, and (iii) they do not cause wind noise. For these and other reasons, such glass antennas are in widespread use.

When receiving radio waves in the VHF band (FM band and TV band), the antenna element often receives reflecting waves as well as direct waves from the broadcasting antenna. The reflecting waves are reflected from the ground and from structures such as buildings. Sometimes, not only one reflecting wave but also several reflecting waves reach the antenna element from several reflection paths. When two radio waves having opposite phases are received, the received radio signal becomes weaker.

Thus, diversity antenna systems have been developed and put into practice, in which two antenna elements with different directionality are provided, and while the vehicle is in motion, the antenna element with the stronger reception signal is selected.

The antenna elements constituting such a diversity antenna system have to have different directionality. For example, in the automobile glass antennas disclosed in JP H10-13127A (1998) and JP H10-242730A (1998), antenna elements are provided on the left and right side windows to form a diversity antenna.

When antenna elements are provided on the left and right side windows, the antenna elements are provided at different locations, and the influence of the metal monocoque constituting the car body on each of the antenna elements is different. Therefore, the two antenna elements have different directionality, so that they preferably can be used for a diversity antenna.

In the vehicle glass antenna disclosed in JP H09-181514A (1997), two antenna elements are provided at the margin portion above the heating conductive lines on a rear window glass, and at least one antenna element is provided at the lower margin portion. These upper and lower antenna elements constitute a diversity antenna.

According to the "Embodiments of the Invention" of this publication, "With respect to the two horizontal antenna elements provided at the upper margin portion, in order to efficiently utilize the length from one lateral edge to the other lateral edge of the window, the horizontal length is ensured by partitioning them not vertically into two, but partitioning them horizontally into two." Moreover, a complicated branching pattern is shown as the pattern of the two antenna elements provided at the upper margin portion. It is explained "there are one or two antenna elements provided at the margin portion below the heating lines, and if two antenna elements are provided, they should be divided into left and right parts."

Furthermore, it is explained that "in diversity receiving, (i) audio signals of FM broadcasting waves should be diversity-received with one antenna element at the upper margin portion and one antenna element at the lower margin portion, and signals that are not audio signals of FM broadcasting waves, such as text signals, should be diversity-received with the other antenna element at the upper margin portion and the other antenna element at the lower margin portion or an antenna element provided at a separate location, or (ii) signals that are not audio signals of FM broadcasting waves should be diversity-received with one antenna element at the upper margin portion and one antenna element at the lower margin portion, and audio signals of FM text broadcasting waves should be diversity-received with the other antenna element at the upper margin portion and the other antenna element at the lower margin portion or an antenna provided at a separate location."

The present applicant has disclosed a vehicle glass antenna system in WO 00/70708.

In the glass antenna system shown in FIG. 3 of that application, an FM (main) antenna of one conductive line is provided above a defogging heater, and an FM sub-antenna of one conductive line is provided below the defogging heater on a rear glass, thus constituting a diversity antenna. Furthermore, in this antenna system, an AM antenna is provided above the FM (main) antenna.

If diversity reception is performed with two antenna elements provided at the margin portion above and the margin portion below the heating lines of a vehicle rear window glass, as in the vehicle glass antenna system disclosed in JP H09-181514A (1997), the following problems occur.

The antenna elements are provided at different heights at the margin portion above and the margin portion below the heating lines, so that a difference in the basic receiving sensitivities of the two antenna elements occurs. More specifically, the receiving sensitivity of the antenna provided at the lower margin portion often deteriorates. Furthermore, it is also susceptible to the adverse influence of the rear tray of the car body. With the vehicle glass antenna disclosed in JP H09-181514 (1997), it is sometimes difficult to attain a consistently superior receiving sensitivity, even when performing diversity reception.

SUMMARY OF THE INVENTION

It is an object of the present invention to provide a glass antenna for vehicles whose receiving sensitivity does not decrease considerably when switching between the antenna elements of the diversity antenna, and to provide a glass antenna system using the same.

The glass antenna of the present invention is suitable for receiving radio waves in the VHF band with a frequency of 76 to 108 MHz. The radio waves in this frequency range include not only FM broadcasts but also a part of TV broadcasts (e.g. channels 1 to 3 in Japan).

A glass antenna according to the present invention includes a window glass; a defogging heater including a plurality of conductive lines arranged on the window glass; a first antenna element and a second antenna element arranged at an upper portion relative to the heater on the window glass; and a first feeding point for the first antenna element formed at a left side of the window glass and a second feeding point for the second antenna element formed at a right side of the glass. The first antenna element and the second antenna element each are capacitively coupled with the heater.

A glass antenna system according to the present invention includes the glass antenna and a module for selecting either one element, from the first antenna element and the second antenna element, that provides a stronger reception signal.

DETAILED DESCRIPTION OF THE INVENTION

The first and second antenna elements are suitable for receiving radio waves in the VHF band with a frequency of 76 to 108 MHz. A first antenna element and a second antenna element are provided at the margin portion above a defogging heater provided on a window glass. Therefore, the antenna elements can be arranged at higher positions from the ground, so that the advantage of a higher sensitivity can be attained.

A feeding point for the first antenna element is formed at a left side of the glass, and a feeding point for the second antenna element is formed at a right side of the glass. Thus, the positions of the feeding points are considerably different, so that the first antenna element and the second antenna element can be provided with considerably different directionalities that can complement one another.

Each of the first antenna element and the second antenna element is capacitively coupled with the defogging heater. Consequently, the receiving sensitivity for FM broadcasts and TV broadcasts (VHF-Low) can be improved, because the defogging heater can be utilized as an auxiliary antenna for the VHF band. A preferable distance between the first or the second antenna element and the heater is 3 to 20 mm.

The defogging heater as an AM antenna causes noise if no choke coil is arranged between the defogging heater and the power source in the vehicle. When the defogging heater is not used as an auxiliary AM antenna, it is not necessary to provide a choke coil between the defogging heater and the power source. Thus, it is possible to prevent cost increases for the antenna system.

It is preferable that the first antenna element and the second antenna element are formed such that they do not overlap in a vertical direction of the window glass. Thus, the interference between the antenna elements can be reduced, and a superior receiving sensitivity can be attained.

Figure 1:
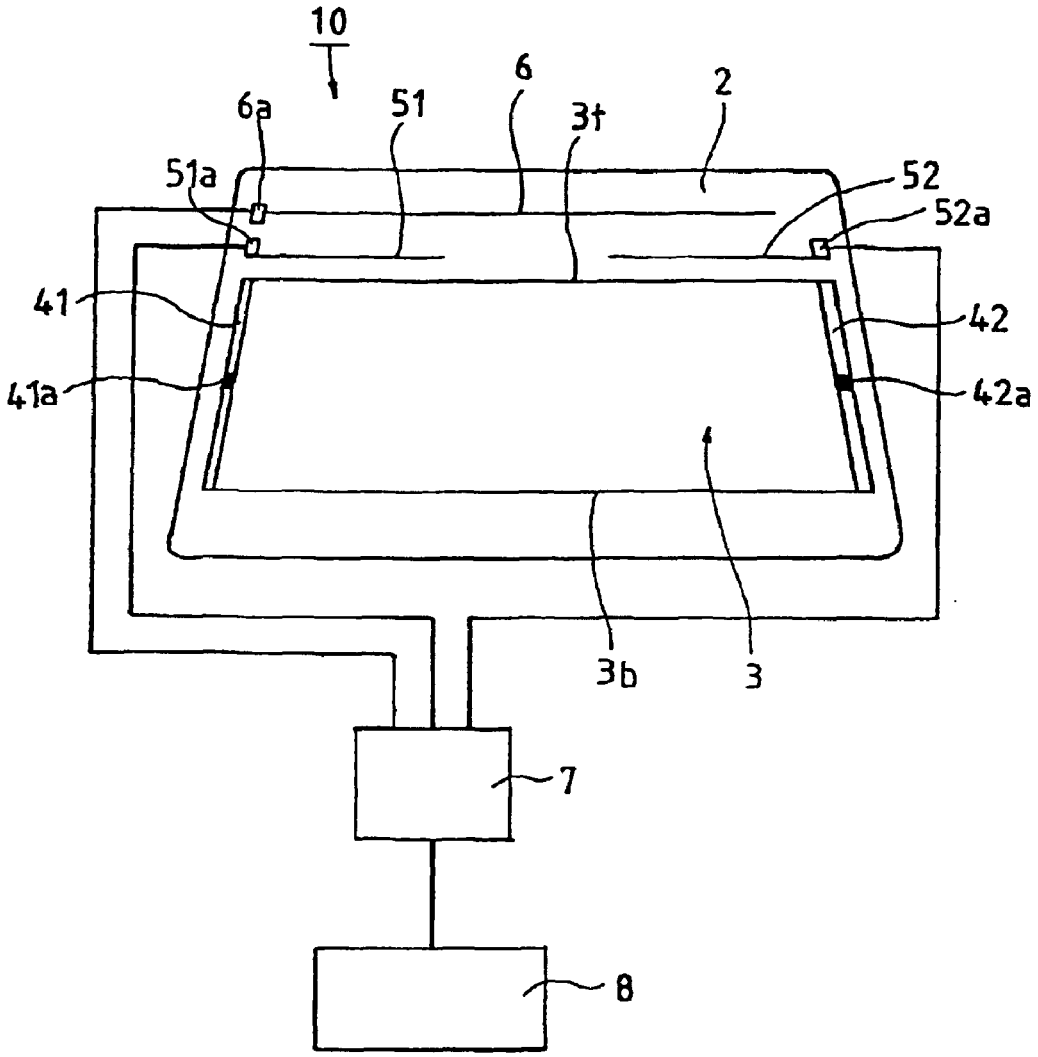
FIG. 1 shows an embodiment of a glass antenna system in accordance with the present invention.
Figure 12:
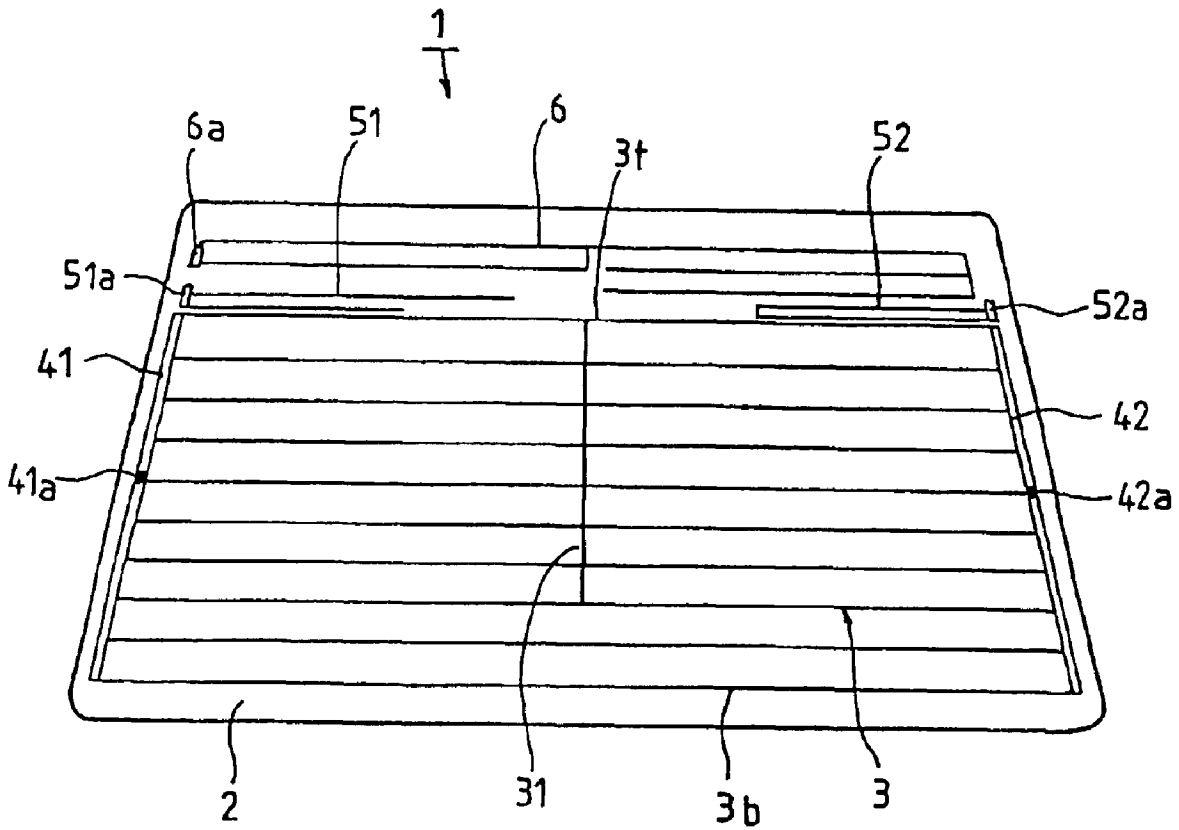
FIG. 12 illustrates a glass antenna in accordance with Specific Example 2.

The first antenna element and the second antenna element can be made of one conductive line as shown in FIG. 1, or fork-shaped patterns with two or more lines or loop-shaped patterns as shown in FIG. 12.

The first antenna element and the second antenna element can have the same pattern or they can be different, taking into consideration the diversity effect.

It is possible to provide further a third antenna element for medium frequency wave at an upper portion relative to the heater, preferably above the first antenna element and the second antenna element.

For example, it is preferable that the first antenna element and the second antenna element are designed as bar-shaped patterns, because then their shape is simple so that they easily can be adjusted for receiving waves at design frequency. Moreover, the bar-shaped patterns can create a larger space for the medium wave antenna above the first and the second antenna elements. This is preferable, because the receiving sensitivity of medium wave antennas is basically proportional to the surface area of the antenna.

When the first antenna element and the second antenna element of the present invention are provided with simple bar-shaped patterns, then it is sufficient to change only the length of the antenna elements to modify the design frequency, when moving into a different service area so that the frequency band to be received changes. That is to say, it is not necessary to change or adjust the pattern shape.

EXAMPLE 1

In a glass antenna system 10 as shown in FIG. 1, a defogging heater 3 is provided in the middle of a vehicle rear window glass 2. The respective ends of the heater lines that constitute the defogging heater 3 are connected to bus bars 41 and 42. In some of the attached drawings, heater lines other than the top line 3*t* and the bottom line 3*b* are not shown. Feeding points 41*a* and 42*a* provided on the bus bars are connected via a switch mechanism (not shown in the drawings) to a power source (not shown in the drawings).

The heater lines, the bus bars, and the antenna elements described below can be made by applying silver paste in a predetermined pattern.

A first antenna element 51 is formed as a bar-shaped horizontal line extending from a first antenna feeding point 51*a* provided on the left side of the glass at a margin portion above the heater line 3*t*. The first antenna element 51 is connected via a terminal provided at the feeding point 51*a* to a diversity module 7. A second antenna element 52 similarly is formed as a bar-shaped horizontal line extending from a second antenna feeding point 52*a* provided on the right side of the glass at a margin portion above the heater line 3*t*. The signal received with the second antenna element 52 is carried to the diversity module 7. The feeding point of the first antenna element is formed on the left side from the center of the window glass, whereas the feeding point of the second antenna element is formed on the right side from the center.

The diversity module 7 selects, from the first antenna element 51 and the second antenna element 52, the element that has the stronger receiving intensity. The selected reception signal is fed into a receiving device 8.

The first and second antenna elements 51 and 52 and the defogging heater 3 are not connected directly to one another, but coupled capacitively. Capacitive coupling can be attained if the distance of the first and second antenna elements 51 and 52 to the uppermost heater line 3*t* is set to a predetermined distance (preferably 3 to 20 mm).

Figure 2:
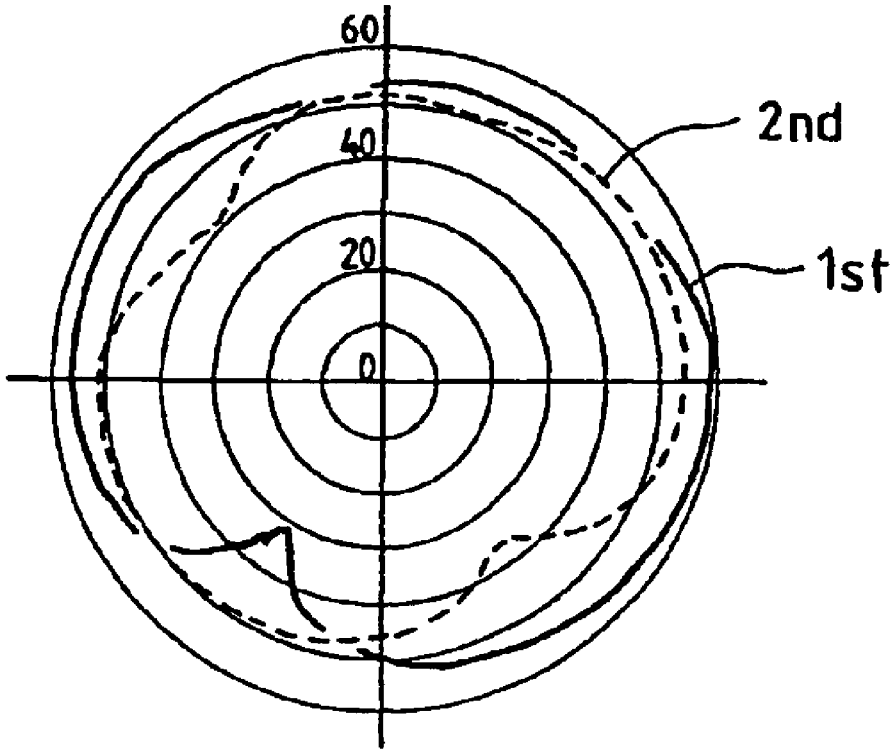
FIG. 2 illustrates the directionality of the glass antenna in FIG. 1.

FIG. 2 shows the results of measuring the directionality of the first and second antenna elements in this Example 1. As becomes clear from FIG. 2, to constitute a diversity antenna, it is preferable if the first and second antenna elements have different directionalities.

For example, it can be seen that the directionality of the first antenna element is such that its sensitivity with respect to the 7 o'clock direction (in terms of clock dial directions) is low, but the second antenna element has a high sensitivity with respect to that direction. On the other hand, the directionality of the second antenna element is such that its sensitivity with respect to the 5 o'clock and 10 o'clock directions (in terms of dock dial directions) is relatively low, but the first antenna element has a high sensitivity with respect to these directions. Thus, the first and second antenna elements complement each other's receiving sensitivity over all orientations.

Figure 3:
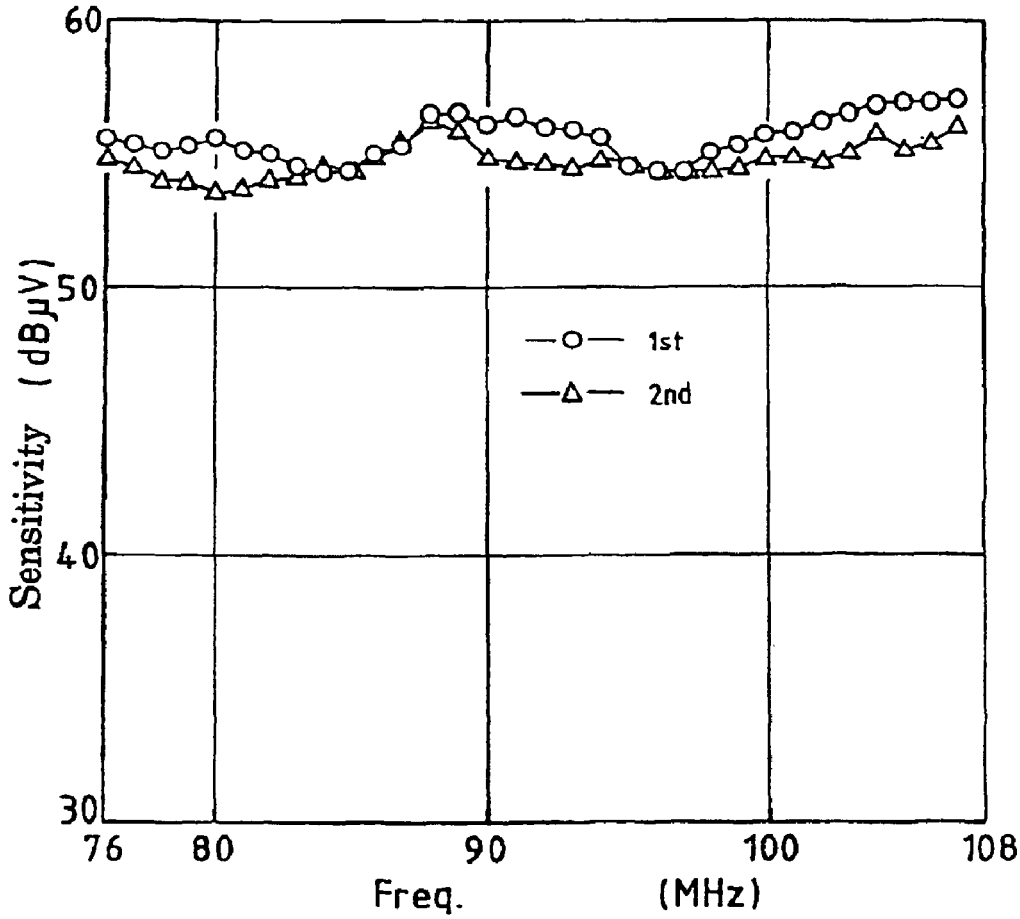
FIG. 3 illustrates the frequency characteristics of the glass antenna in FIG. 1.

FIG. 3 shows the measured frequency characteristics of a glass antenna in accordance with Example 1. The receiving sensitivity of the first antenna element is on average 55.9 dB$\mu$V, and the receiving sensitivity of the second antenna element is on average 54.9 dB$\mu$V. As becomes clear from FIG. 3, the receiving sensitivities of both the first and the second antenna elements are substantially flat over the VHF band, and their sensitivity levels are substantially the same.

Furthermore, in Example 1, a medium wave (AM) antenna element 6 also is provided in the margin portion above the first and second antenna elements 51 and 52. It is preferable that the distance between the first and second antenna elements 51 and 52 and the AM antenna 6 is set to at least a predetermined distance (for example, at least 25 mm), so that interference between the first and second antenna elements 51 and 52 and the AM antenna 6 can be suppressed.

Also the medium wave (AM) antenna element 6 is connected via a terminal provided at the feeding point 6*a* to the diversity module 7, which includes a switching circuit for switching between medium wave and very high-frequency waves, and the signal received with the AM antenna element 6 is fed into the receiving device 8.

Thus, by arranging the defogging heater 3, the AM antenna 6, and the first and second antenna elements 51 and 52 at suitable locations, it is possible to minimize the interference between the AM antenna 6 and the first and second antenna elements 51 and 52 as well as the interference between the AM antenna 6 and the defogging heater 3.

In Example 1, a separate diversity module is provided, but it is also possible to integrate the diversity module with the receiving device 8. Moreover, there is a certain distance between the glass antenna and the receiving device, and it is also possible to provide an antenna amplifier between the two, if sufficient signal strength cannot be ensured

COMPARATIVE EXAMPLE 1

Figure 4:
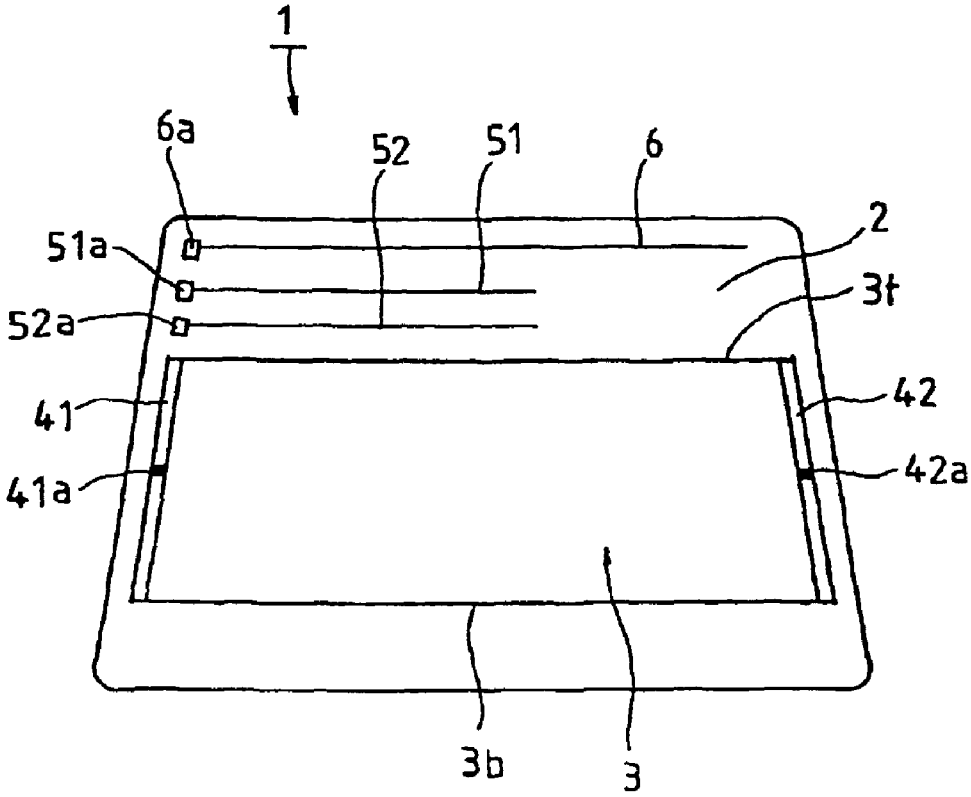
FIG. 4 illustrates a glass antenna in accordance with Comparative Example 1.

FIG. 4 illustrates the arrangement of antenna elements of Comparative Example 1. In this glass antenna 1, the second antenna element 52 is arranged between the first antenna element 51 and the defogging heater 3. Both the first and the second antenna element are capacitively coupled with the defogging heater.

Figure 5:
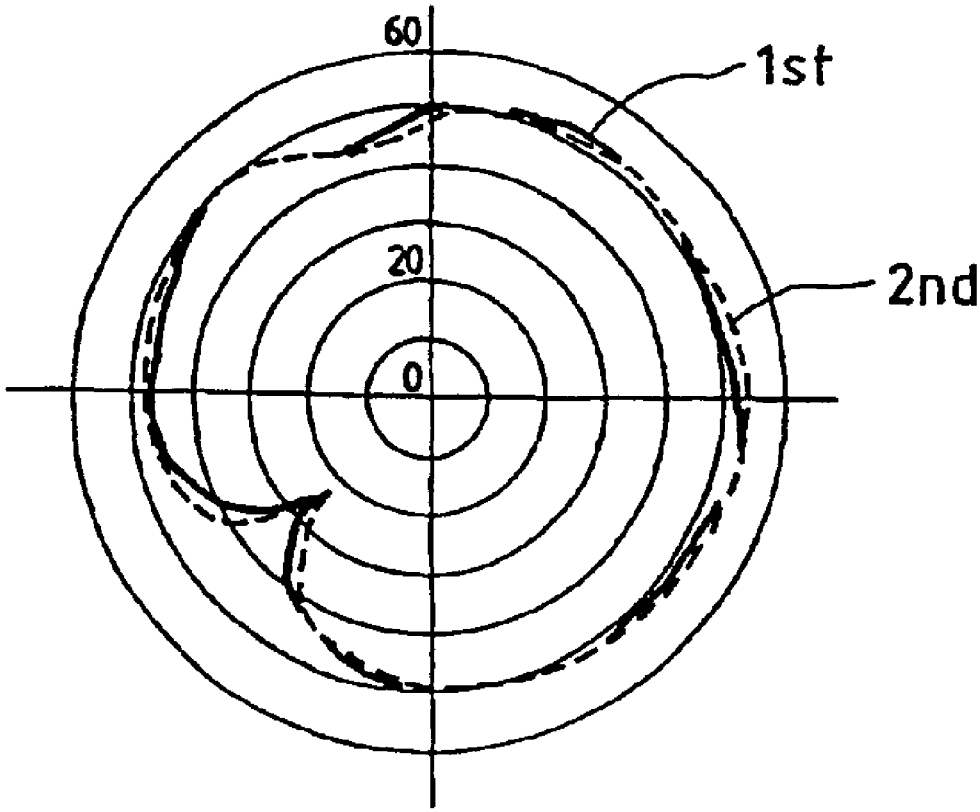
FIG. 5 illustrates the directionality of the glass antenna in FIG. 4.

FIG. 5 illustrates the directionality of the glass antenna in Comparative Example 1. As becomes clear from FIG. 5, the first and the second antenna elements have substantially the same directionality, and the receiving sensitivity decreases for both between 7 and 8 o'clock, so that this arrangement is not suitable for a diversity antenna.

Figure 6:
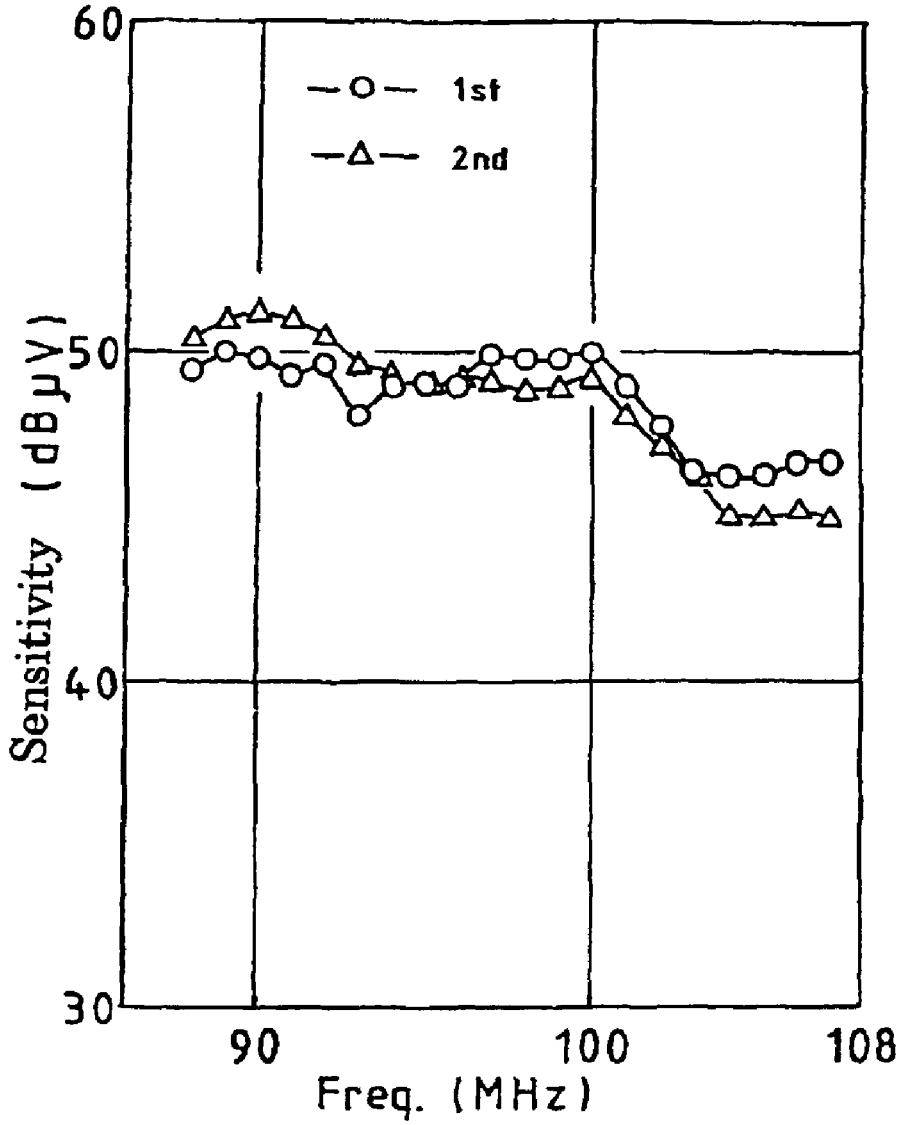
FIG. 6 illustrates the frequency characteristics of the glass antenna in FIG. 4.

FIG. 6 shows the measured frequency characteristics for Comparative Example 1. The receiving sensitivity of the first antenna element is on average 48.6 dB$\mu$V, and the receiving sensitivity of the second antenna element is on average 48.5 dB$\mu$V. As becomes clear from FIG. 6, the receiving sensitivities of the first and second antenna elements are about 7 dB lower than in Example 1. It seems that this is because the first and the second antenna elements are arranged one above the other, so that the receiving sensitivity decreases due to interference.

It also can be seen from FIG. 6, that the receiving sensitivities of the first and second antenna elements have similar frequency characteristics. In particular, at 100 MHz, the sensitivity begins to drop and at 104 to 107 MHz, they have roughly the same flat characteristics. It also can be seen that their sensitivity level is about the same.

Comparing Example 1 with Comparative Example 1, the following aspects become clear:

When the feeding points of the first and second antenna elements are on the same side of the window glass, the antenna elements will have similar directionalities. Consequently, configuring a diversity antenna with a plurality of antenna elements, it is preferable that the feeding points of the antenna elements are not arranged on the same side of the window glass.

Also, in order to avoid interference, it is desirable to arrange the first and second antenna elements so as not to overlap in vertical direction.

COMPARATIVE EXAMPLE 2

Figure 7:
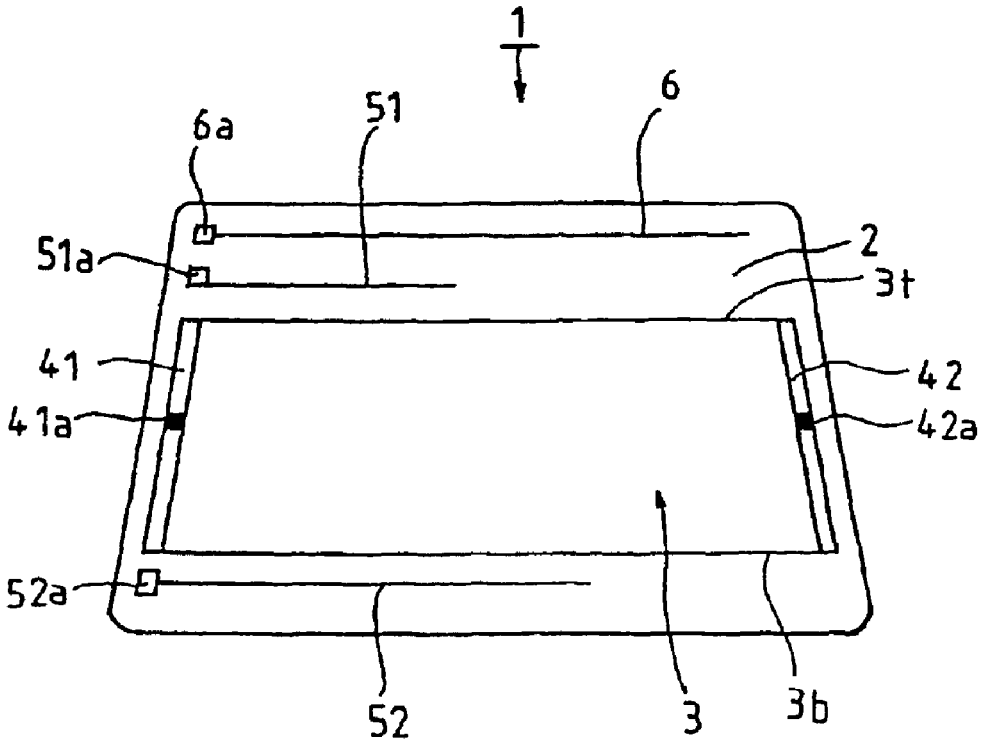
FIG. 7 illustrates a glass antenna in accordance with Comparative Example 2.

FIG. 7 illustrates the arrangement of antenna elements of Comparative Example 2. In this glass antenna, the second antenna element 52 is arranged at the margin portion below the defogging heater 3. In this example, the first antenna element and the second antenna element are capacitively coupled with the defogging heater.

Figure 8:
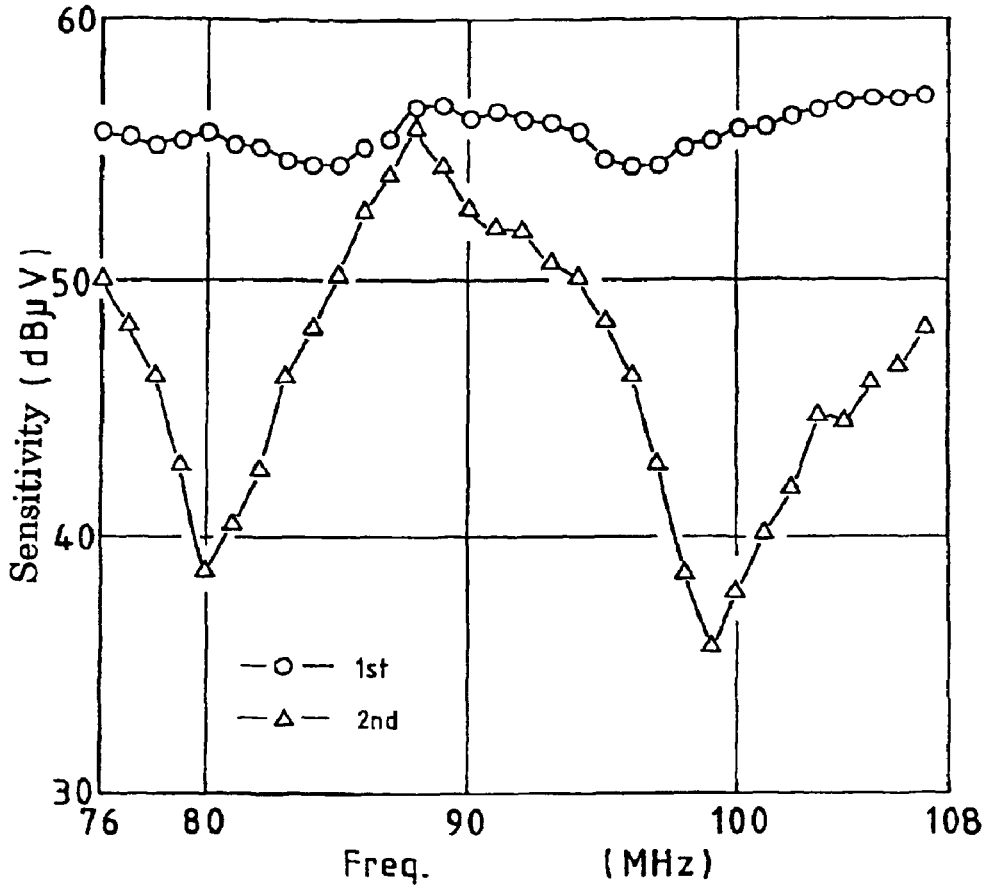
FIG. 8 illustrates the frequency characteristics of the glass antenna in FIG. 7.

FIG. 8 shows the measurement results for the frequency characteristics in Comparative Example 2. The receiving sensitivity of the first antenna element is on average 55.9 dB$\mu$V, and the receiving sensitivity of the second antenna element is on average 46.5 dB$\mu$V. As becomes clear from FIG. 8, the receiving sensitivity of the second antenna element arranged at the margin portion below the defogging heater 3 is lower than that of the first antenna element, and in particular around 80 MHz and 99 MHz, it is much lower than that of the first antenna element.

It seems that this is because the second antenna element is arranged at a lower position than the first antenna element, so that it is susceptible to the adverse influence of the rear tray.

Comparing Example 1 with Comparative Example 2, the following aspects become clear:

When configuring a diversity antenna with a plurality of antenna elements, it is preferable with regard to receiving sensitivity that the antenna elements are arranged at substantially the same height.

COMPARATIVE EXAMPLE 3

Figure 9:
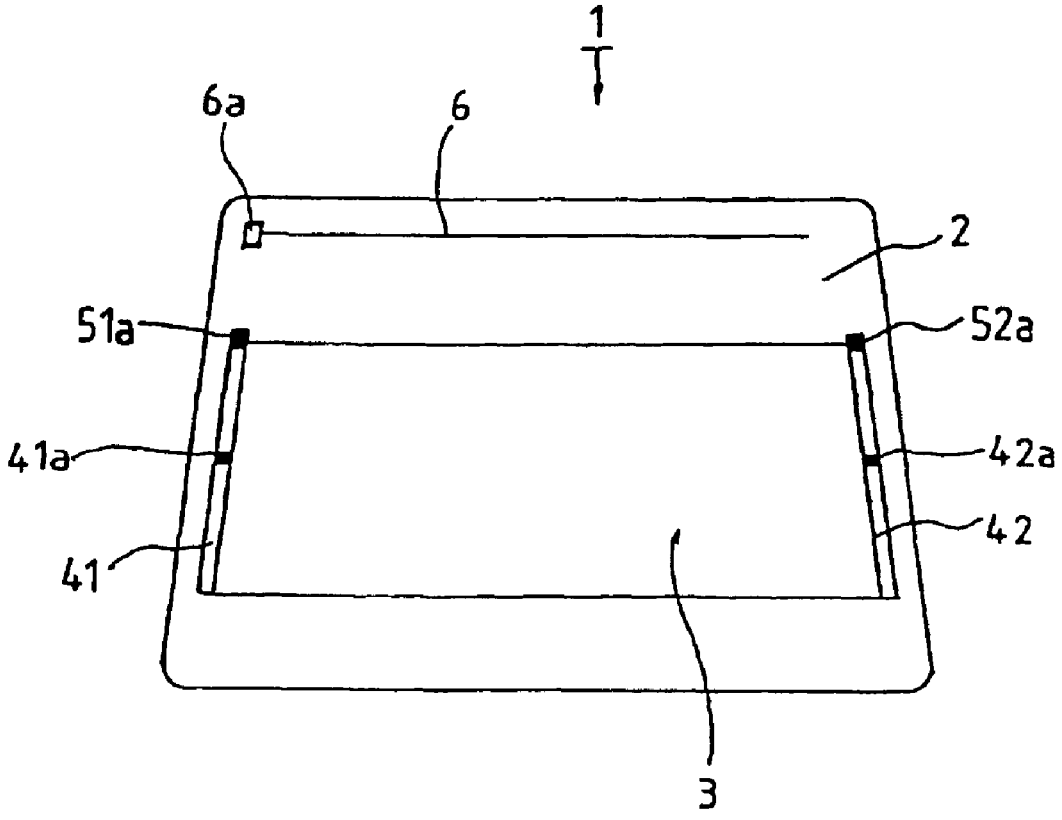
FIG. 9 illustrates a glass antenna in accordance with Comparative Example 3.

FIG. 9 illustrates the arrangement of antenna elements of Comparative Example 3. In this glass antenna 1, the feeding points 51*a* and 51*b* are arranged at the upper portions of the left and right bus bars 41 and 42. That is to say, in this example, the feeding points 51*a* and 52*a* are arranged at the left and right bus bars 41 and 42 of the defogging heater to use the defogging heater as the first and second antenna elements.

Figure 10:
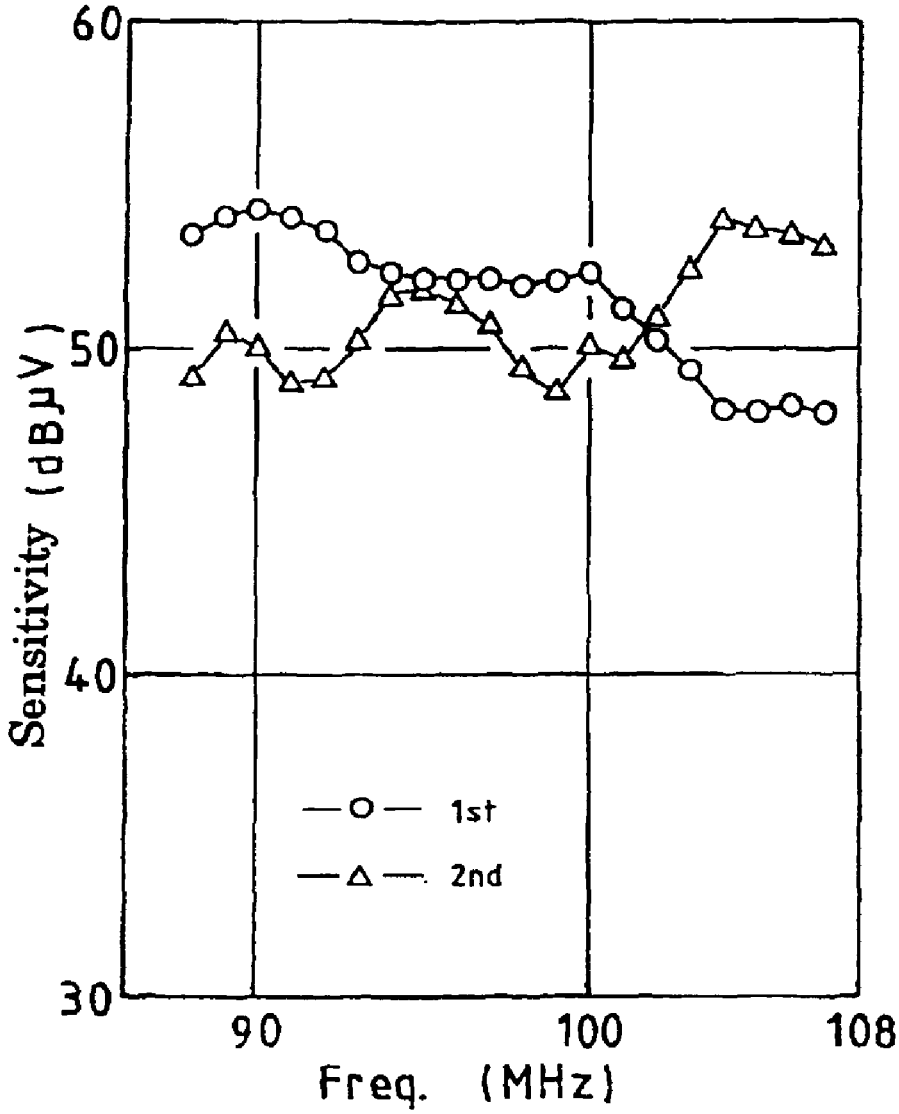
FIG. 10 illustrates the frequency characteristics of the glass antenna in FIG. 9.

FIG. 10 shows the measurement results for the frequency characteristics of Comparative Example 3. The receiving sensitivity of the first antenna element is on average 51.5 dB$\mu$V, and the receiving sensitivity of the second antenna element is on average 50.9 dB$\mu$V. As becomes clear from FIG. 10, the receiving sensitivity of this example is about 5 dB lower than in Example 1.

Comparing Example 1 with Comparative Example 3, the following aspects become clear:

In Comparative Example 3, the feeding points of the plurality of antenna elements constituting the diversity antenna are arranged at very different positions on the window glass. Furthermore, these antenna elements are arranged at approximately the same height. These aspects are the same as in Example 1. However, in Comparative Example 3, the antenna pattern constituting the diversity antenna is shared, so that a favorable receiving sensitivity could not be attained.

SPECIFIC EXAMPLE 1

Figure 11:
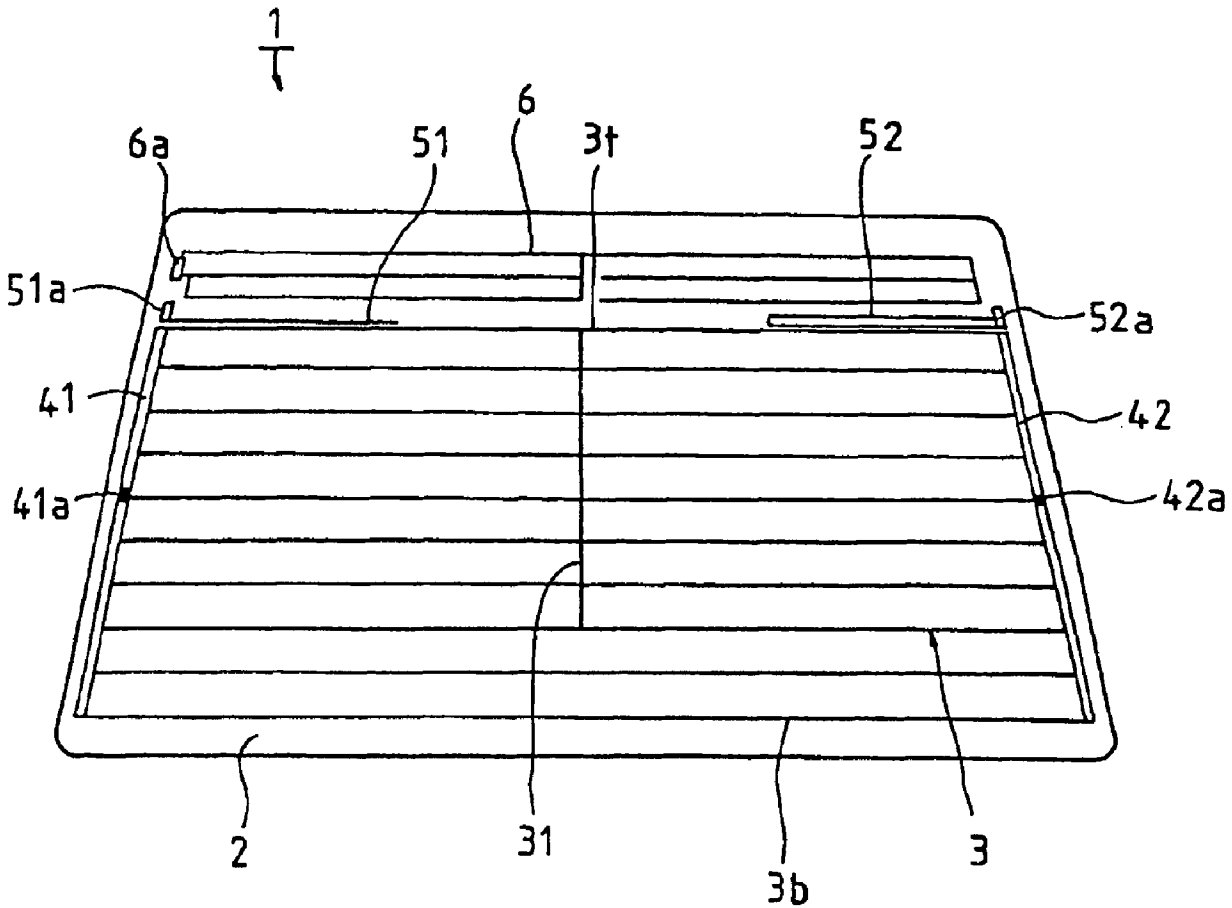
FIG. 11 illustrates a glass antenna in accordance with Specific Example 1.

In the glass antenna 1 shown in FIG. 11, a defogging heater 3 is provided in the middle of a vehicle rear window glass 2. The respective ends of the heater lines 3*t* to 3*b* constituting the defogging heater 3 are connected to bus bars 41 and 42.

A first antenna element 51 is formed as a bar-shaped horizontal conductor element extending from a feeding point 51*a* for the first antenna element provided on the left side of the glass at a margin portion above the heater line 3*t* of the defogging heater 3.

A second antenna element 52 includes a loop-shaped pattern extending from a feeding point 52*a* for the second antenna element provided on the right side of the glass at a margin portion above the heater line 3*t* of the defogging heater 3.

The defogging heater 3 is provided with a shorting line 31 for shorting the middle portions of some of the heater lines, including the top line 3*t*.

SPECIFIC EXAMPLE 2

Specific Example 2 is a glass antenna 1, in which the first antenna element of Specific Example 1 has been modified. As shown in FIG. 12, the first antenna element 51 has a two-tine fork pattern, whereas the second antenna element 52 has a loop-shaped pattern.

Also in this Specific Example 2, the defogging heater 3 is provided with a shorting line 31.

Moreover, the pattern of the medium wave antenna 6 is a little different from that in Specific Example 1.

SPECIFIC EXAMPLE 3

Figure 13:
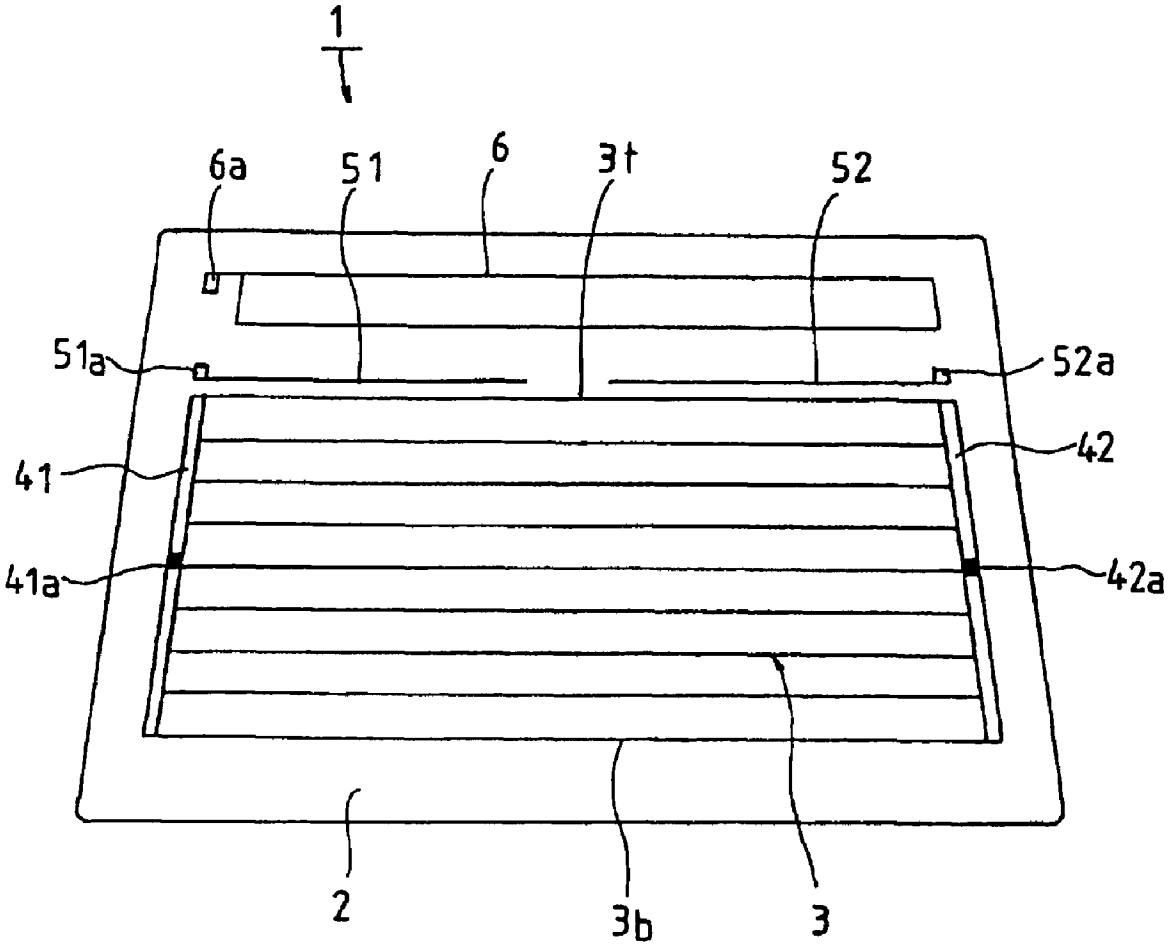
FIG. 13 illustrates a glass antenna in accordance with Specific Example 3.

Specific Example 3 is a glass antenna 1, in which the medium wave antenna element of Example 1 has been modified As shown in FIG. 13, the AM antenna 6 is provided with a loop-shaped pattern.

In all of these specific examples, superior diversity antennas could be provided.

As has been described above, in the glass antenna and the glass antenna system in accordance with the present invention, first and second antenna elements are arranged in a margin portion above a defogging heater provided on a rear window glass, so that the antenna elements can be placed at high positions. Therefore, the advantageous effect of high sensitivity can be attained.

Furthermore, arranging for example the feeding point of the first antenna element on the left side of the glass and the feeding point of the second antenna element on the right side of the glass, the positions of the feeding points of the first and second antenna elements are formed at very distant positions.

Forming the positions of the feeding points of the first and second antenna elements at distant positions in this manner, it is possible to attain basically different directionalities for the first antenna element and the second antenna element. Therefore, their directionalities can complement one another.

In a glass antenna in accordance with the present invention, the first antenna element and the second antenna element are capacitively coupled with the defogging heater. Therefore, the defogging heater can be utilized as an auxiliary antenna for VHF.

What is claimed is:

1. A glass antenna system for vehicles comprising:

a window glass;

a defogging heater including a plurality of conductive lines arranged on the window glass;

a first antenna element and a second antenna element arranged at an upper side relative to the heater on the window glass, each of the first antenna element and the second antenna element being capacitively coupled with the heater;

a first feeding point for the first antenna element arranged at a left side of the window glass, and a second feeding point for the second antenna element arranged at a right side of the window glass;

wherein a distance between the first antenna element and the heater is 3 to 20 mm, and a distance between the second antenna element and the heater is 3 to 20 mm; and a module for selecting either one element, from the first antenna element and the second antenna element, that provides a stronger reception signal.

2. The glass antenna system according to claim 1, wherein the first antenna element and the second antenna element are formed such that the first antenna element and the second antenna element do not overlap with one another in a vertical direction of the window glass.

3. The glass antenna system according to claim 1, wherein the first antenna element and the second antenna element are each made of one conductive line.

4. The glass antenna system according to claim 3, wherein the first antenna element and the second antenna element are each provided with a bar-shaped pattern.

5. The glass antenna system according to claim 1, further comprising a third antenna element for medium frequency waves arranged at an upper side relative to the heater on the window glass.

6. The glass antenna system according to claim 1, wherein the heater is connected to a power source, and no choke coil is provided between the heater and the power source.

7. The glass antenna system according to claim 1, wherein the first antenna element and the second antenna element receive radio waves in the VHF band.

* * * * *